US009371827B2

(12) United States Patent
Lefebvre et al.

(10) Patent No.: US 9,371,827 B2
(45) Date of Patent: Jun. 21, 2016

(54) DIAPHRAGM PUMP WITH HIGH SUCTION CAPACITY

(75) Inventors: Rémy Lefebvre, Radepont (FR); Denis Deparrois, Louviers (FR)

(73) Assignee: Milton Roy Europe, Pont-Saint-Pierre (FR)

( * ) Notice: Subject to any disclaimer, the term of this patent is extended or adjusted under 35 U.S.C. 154(b) by 985 days.

(21) Appl. No.: 13/279,010

(22) Filed: Oct. 21, 2011

(65) Prior Publication Data

US 2012/0269658 A1 Oct. 25, 2012

(30) Foreign Application Priority Data

Oct. 22, 2010 (FR) ..... 10 58678

(51) Int. Cl.

| | |
|---|---|
| ***F04B 43/067*** | (2006.01) |
| ***F15B 1/26*** | (2006.01) |
| ***F04B 43/00*** | (2006.01) |
| ***F04B 53/14*** | (2006.01) |
| *F04B 43/06* | (2006.01) |

(52) U.S. Cl.

CPC ..... *F04B 43/067* (2013.01); *F04B 43/009* (2013.01); *F04B 43/0054* (2013.01); *F04B 53/14* (2013.01); *F15B 1/26* (2013.01); *F04B 43/06* (2013.01)

(58) Field of Classification Search

CPC .... F04B 43/06; F04B 43/067; F04B 43/0054; F15B 10/26

USPC ..... 417/412, 413.1, 383, 385–389, 392, 417/394, 395; 92/97

See application file for complete search history.

(56) References Cited

U.S. PATENT DOCUMENTS

| | | | | | |
|---|---|---|---|---|---|
| 2,578,746 | A | * | 12/1951 | Scherger et al. | 417/388 |
| 3,075,468 | A | * | 1/1963 | Eifel | 417/388 |
| 3,107,624 | A | * | 10/1963 | Williams | F04B 43/067 417/388 |
| 3,164,024 | A | * | 1/1965 | Mitchell | F04B 9/042 417/413.1 |
| 3,373,610 | A | * | 3/1968 | Stieber | 73/334 |
| 3,583,425 | A | * | 6/1971 | O'Connor | F15B 1/26 137/199 |
| 3,666,379 | A | * | 5/1972 | Mitchell | F04B 43/009 417/395 |
| 3,769,879 | A | * | 11/1973 | Lofquist, Jr. | 92/84 |
| 3,807,906 | A | * | 4/1974 | Breit | 417/383 |
| 4,883,412 | A | * | 11/1989 | Malizard | F04B 43/067 417/387 |
| 4,971,523 | A | * | 11/1990 | Wacker et al. | 417/63 |
| 5,074,763 | A | * | 12/1991 | Degremont | 417/413.1 |
| 5,165,869 | A | * | 11/1992 | Reynolds | 417/385 |

(Continued)

FOREIGN PATENT DOCUMENTS

| | | | |
|---|---|---|---|
| EP | 0 460 386 | A1 | 12/1991 |
| FR | 663 466 | A | 8/1929 |
| GB | 1 122 829 | A | 8/1968 |

(Continued)

*Primary Examiner* — Devon Kramer
*Assistant Examiner* — Joseph Herrmann
(74) *Attorney, Agent, or Firm* — Muncy, Geissler, Olds & Lowe, P.C.

(57) ABSTRACT

A hydraulically-controlled diaphragm pump having a pump head in which a first deformable diaphragm defines a pump chamber, a pump body that co-operates with the first diaphragm to define a hydraulic working chamber, and a piston mounted to move back and forth in the pump body so as to form a controlled movable wall of the working chamber. The movable wall also includes at least one second diaphragm secured to the piston head and to the body of the pump, and providing sealing for the working chamber.

7 Claims, 2 Drawing Sheets

(56) References Cited

U.S. PATENT DOCUMENTS

| | | | | |
|---|---|---|---|---|
| 7,425,120 | B2 * | 9/2008 | Hembree | 417/387 |
| 2008/0260549 | A1 * | 10/2008 | Yajima | 417/375 |

FOREIGN PATENT DOCUMENTS

| | | | |
|---|---|---|---|
| GB | 2 388 163 | A | 11/2003 |
| WO | WO 91/02161 | A1 | 2/1991 |

* cited by examiner

Fig.2
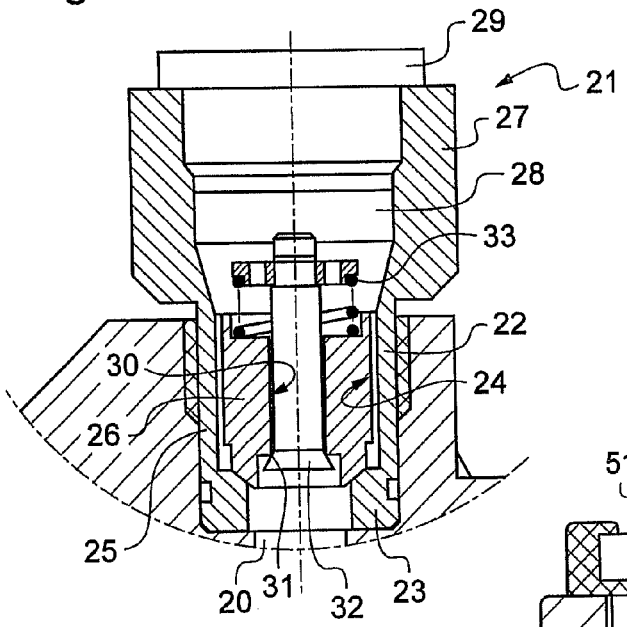
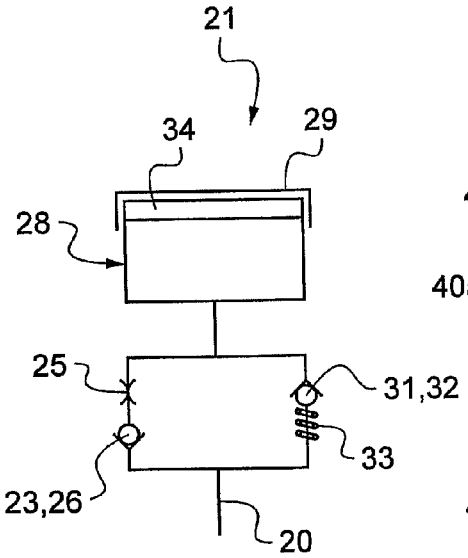
Fig.3
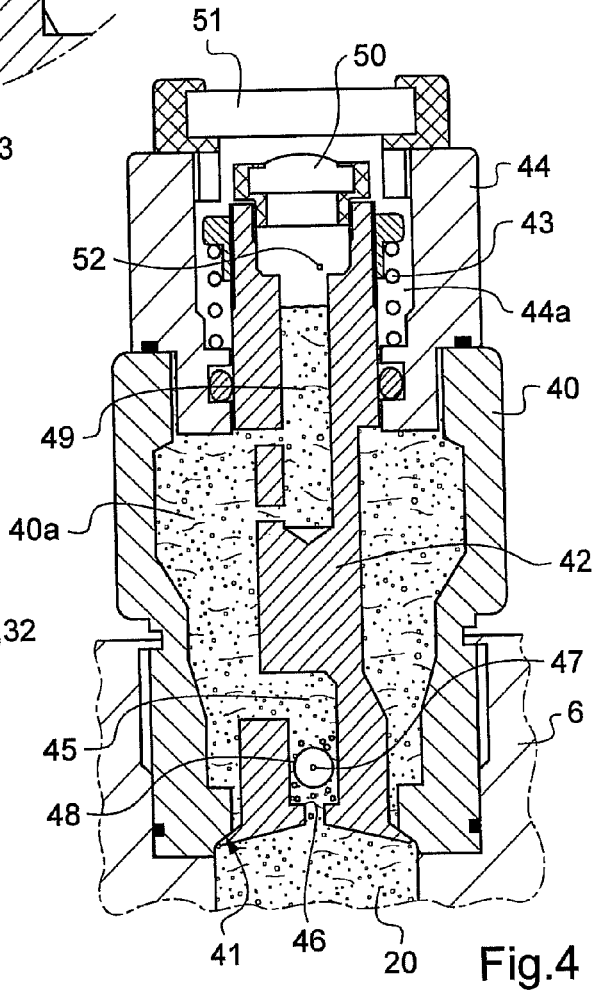
Fig.4

DIAPHRAGM PUMP WITH HIGH SUCTION CAPACITY

The present invention relates to a hydraulically-controlled diaphragm pump, and more particularly to a diaphragm pump having high suction capacity.

BACKGROUND OF THE INVENTION

Presently-known diaphragm pumps that are mass-produced generally have a suction capacity of the order of a water column of 4 meters (m) (and up to a water column of 7 m in special designs). This capacity can be increased by careful manufacture beyond the standards of mass production, resulting in special devices that differ from conventional pumps, in particular in terms of price. Such "special" pumps are of conventional architecture, with a compensation valve for compensating leaks of hydraulic oil (transmission oil leaks between the diaphragm and a piston that is mechanically driven back and forth), a rated safety valve for allowing hydraulic oil to escape in the event of excess pressure, and a device for de-gassing and purging air in order to evacuate, usually continuously, the air or gas that is present in the circuit firstly when the pump is put into operation and that comes secondly from gas that is dissolved in the oil itself and that returns to the gaseous state as a result of variations in the pressure of the medium that contains the gas in solution. The increase in the suction capacity of such "special" pumps results from the care applied to the fabrication and to the assembly of each of the parts making up the moving equipment of the pump for the purpose of optimizing clearances and fitting between the various components.

There exists a need for pumps having high suction capacity (of the order of 9 m of water column) that are capable of being mass-produced, and thus with fabrication and assembly constraints that come within the ranges of tolerance that are normal for mass production in this field, in order to remain within market prices.

OBJECT OF THE INVENTION

The invention constitutes a response to this need in that it provides a diaphragm pump of architecture that is modified in order to limit or even eliminate certain elements for which fabrication tolerances need to be very tight in order to achieve the required suction performance.

The invention thus provides a hydraulically-controlled diaphragm pump comprising:

- a pump head in which a first deformable diaphragm defines a pump chamber;
- a pump body that co-operates with the first diaphragm to define a hydraulic working chamber; and
- a piston mounted to move back and forth in the pump body so as to form a controlled movable wall of the working chamber.

The controlled movable wall also includes at least one second diaphragm secured to the piston head and to the body of the pump, and providing sealing for the working chamber.

This second sealing diaphragm of the movable wall serves to eliminate leaks of oil from the working chamber along the piston where it co-operates in sliding with the body, and to do so regardless of the sealing gaskets that are implemented. In preferred manner, the second diaphragm that is used is of the same type as the mechanically actuated diaphragm described in document FR 2 697 589. Eliminating these leaks thus reduces the topping-up requirements of the working chamber, and thus the volume of compensation fluid that is needed for such topping up.

In order to improve this sealing, a third diaphragm is arranged between the piston and the pump body in order to co-operate with the second diaphragm secured to the piston head so as to form within the pump body a closed chamber that is filled with oil and in which the piston and the body co-operate in sliding. Thus, the second diaphragm at the front is suitable for accommodating the delivery pressure of the pump, while the third diaphragm at the rear is capable of accommodating a high suction value corresponding to a high suction capacity.

The safety valve, for protecting the pump from excess pressure on delivery, is a member that also puts a limit on the suction capacity of a pump. When triggered, it purges the working chamber of a certain amount of oil, which requires an oil top-up valve to be put into place. The safety valve and the top-up valve of the pump are particularly important when the cylinder capacity of the pump is large, as are the potential leaks and the uncontrolled ingress of fluid into the working chamber when it is under negative pressure. In the pump of the invention, the piston comprises two telescopic portions that are maintained in an extended position by a spring that is rated at a value corresponding to a safety setting. The safety valve is then omitted, thereby avoiding the drawback that stems from its existence, given the suction capacity.

Furthermore, in the pump of the invention, the working chamber is connected to a sealed reserve capacity for topping up and de-gassing the working chamber by means of pipework comprising two mutually parallel channels, a de-gassing, first channel being fitted with a check valve in series with a constriction of section, with a flow direction that is towards the reserve capacity, and a topping up, second channel being fitted with a rated check valve through which the flow direction is towards the working chamber. This reserve capacity may be very small in size, since the topping-up requirements have been reduced. This small size makes it possible without drawback for this capacity to contain a high pressure, namely the delivery pressure of the pump, which pressure is easily isolated from the working chamber by a check valve when the working chamber is under negative suction pressure. This capacity may receive the gas contained in the circuit and the oil of the working chamber, which gas then accumulates above the reserve oil. In order to do this, the reserve capacity is situated above the working chamber when the pump is in operation and the de-gassing check valve is a heavy body.

Finally, and advantageously, the topping-up channel is provided in the body of the de-gassing check valve, while the reserve capacity is made in the form of an assembly that is fitted on the pump body, said assembly including a transparent plug for monitoring the level of oil in the capacity.

Other characteristics and advantages of the invention appear from the description below of an embodiment of the invention.

BRIEF DESCRIPTION OF THE DRAWINGS

Reference is made to the accompanying drawings, in which:

FIG. 2 is an axial section view showing a detail of the pump of the invention;

FIG. 3 is a functional diagram of the components of FIG. 2; and

FIG. 4 is a like axial section view showing a variant embodiment of the topping-up/de-gassing valve.

DETAILED DESCRIPTION OF THE INVENTION

Figure 1:
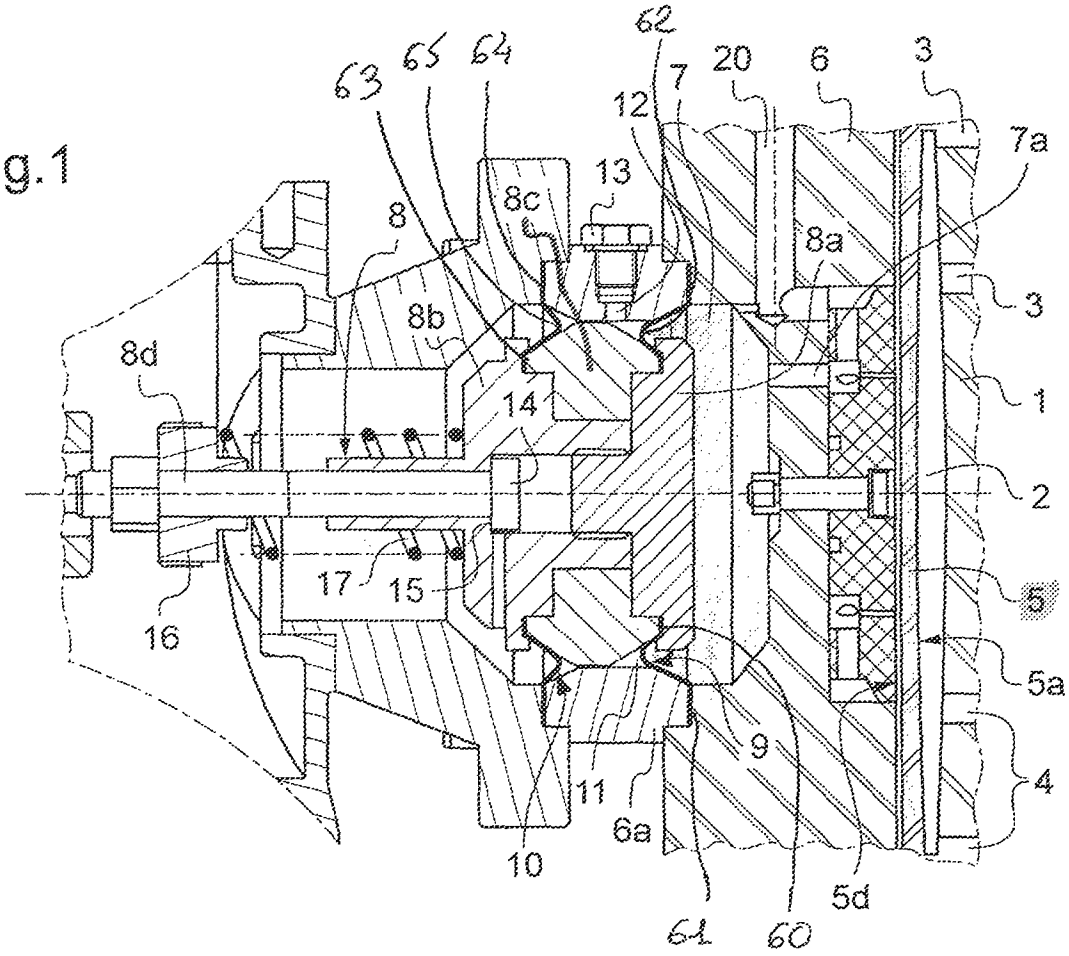
FIG. 1 is a fragmentary section view of a pump in accordance with the invention.

In FIG. 1, there can be seen a pump head 1 that forms a stationary wall in a pump chamber 2 into which there open out suction ducts 3 and delivery ducts 4. In conventional manner, the ducts are fitted with valve boxes (not shown) through which the fluid is sucked in order to enter into the pump chamber and is delivered under pressure on going away from the chamber.

The other wall of the pump chamber is formed by a first deformable diaphragm 5, itself known, clamped in leaktight manner at its periphery between the head 1 and the body 6 of the pump. The face 5*a* of the first diaphragm 5 faces towards the pump chamber 2, while the opposite or rear face 5*b* is exposed to the pressure of the fluid that exists in a hydraulic working chamber 7. The hydraulic chamber 7 is arranged in the pump body with fluid-passing channels 7*a* that enable fluid to reach the rear face 5*b* of the first diaphragm 5. The hydraulic chamber receives the head of a piston 8 that is driven with reciprocating rectilinear motion by means of a conventional mechanical transmission that acts on the piston remote from its head.

The head of the piston is constituted in this example by a front plate 8*a* assembled to a rear plate 8*b* by screw-fastening, with an intermediate spacer 8*c* clamped between them. The piston head is guided in sliding by a ring 6*a* secured to the body 6, surrounding the spacer 8*c*. A second diaphragm 9 of annular shape, and more precisely of a shape similar to that described in document FR 2 697 589 (which relates to a mechanically-actuated diaphragm pump), has an inner peripheral portion 60 that is substantially plane and that is clamped in leaktight manner between the front plate 8*a* and the spacer 8*c* of the piston head, and an outer peripheral portion 61 is that is substantially plane and that is clamped in leaktight manner between the ring 6*a* and the body 6. The second diaphragm 9 includes an intermediate portion 62 between its outer peripheral portion 61 and its inner peripheral portion 60, the intermediate portion 62 being concave with its concave side facing towards the hydraulic working chamber 7.

In the same manner, a third diaphragm 10, similar to the second diaphragm 9, has an inner peripheral portion 63 that is substantially plane and that is clamped in leaktight manner between the spacer 8*c* and the rear plate 8*b* of the piston head 8, and an outer peripheral portion 64 that is substantially plane and that is clamped in leaktight manner between the ring 6*a* and the body 6. The third diaphragm 10 includes an intermediate portion 65 between its outer peripheral portion 64 and its inner peripheral portion 63, the intermediate portion 65 being concave, with its concave side facing towards the rear plate 8*b*.

As a result, the intermediate portion of the second diaphragm 9 and the intermediate portion of the third diaphragm 10 have their concave sides facing in opposite directions, the concave sides of the concave portions facing towards the outside of the closed chamber 11.

Thus, between the second and third diaphragms 9 and 10, the spacer 8, and the ring 6*a*, there exists a sealed chamber 11 that is filled with oil by means of a duct 12 that is closed by a plug 13. The fluid in this chamber provides hydraulic coupling between the second diaphragm 9 and the third diaphragm 10, thereby enabling the third diaphragm 10 to transmit its own ability to draw a vacuum to the second diaphragm 9, with the second diaphragm 9 having a design that enables it to accommodate the delivery pressure. The two diaphragms as coupled together in this way constitute the moving wall of the chamber 7. Since sealing of the working chamber 7 in register with the piston 8 is completely leaktight as a result of the second and third diaphragms 9 and 10, there is no need to provide close tolerances between the two parts that move relative to each other. The volume of the chamber 11 is very small, in particular because of the shapes of the second and third diaphragms 9 and 10, thereby making it possible to avoid any air being trapped in the chamber 11 during filling.

Opposite from its head, the piston 8 includes a rod 8*d* that is slidably mounted in the rear plate 8*b* of the head, having a shouldered end 14 capable of bearing against a shoulder 15 of the inner bore in the plate 8*b* that receives the rod 8*d*. The other end of the rod 8*d* carries a nut 16 that serves to adjust the compression of a spring 17 having the effect of pressing the shouldered end 14 of the rod 8*d* against the shoulder 15 of the plate 8*b*. It can thus be understood that the piston 8 behaves like an undeformable piece of moving equipment so long as the delivery pressure does not exceed the rating of the spring 17. Otherwise, the piston head 8 is blocked by the pressure that exists in the working chamber 7, and thus also in the pump chamber 2, and continuing the delivery cycle gives rise to the rod 8*d* being pushed into the piston head. The rating of the spring 17 is thus set at a value that corresponds to a safety setting representative of the maximum delivery pressure that the pump or the pump installation can withstand without damage. Safety is thus ensured without making use of a discharge valve for the working chamber, and thus without any need to top it up with oil, thereby eliminating any sealing imperfections that such a valve would necessarily present, and eliminating the associated topping up system.

A final provision of the invention is shown in the detail view of FIG. 2. The members shown in this figure are installed at the outer opening of a channel 20 that comes from the working chamber 7 (see FIG. 1) and that passes through the pump body 6. A tubular endpiece 21 is fitted by screw-fastening in leaktight manner to the end of the channel 20. The tubular jacket formed by this endpiece is subdivided into two sections. A first section 22 carries a bottom seat 23 through which the fluid from the channel 20 flows, and it defines a cylindrical bore 24 in which a valve member 26 is mounted with calibrated clearance 25. A second section 27 above the valve member 26 defines a reserve capacity 28 for fluid and for accumulating gas. This capacity is closed in leaktight manner by a plug 29 that is transparent in this example.

The valve member 26 is a heavy body that under the effect of gravity tends to rest on the seat 23. In operation, the pump is in a position such that the channel 20 stems from the top portion of the working chamber 7 and is vertical. The valve member 26 is itself fitted with a through channel 30 going from the channel 20 to the capacity 28, which channel passes through a seat 31 and includes a valve member 32 that is normally urged against the seat 31 by a return spring 33 of adjustable force. The valve member 32 leaves its seat 31 only when the difference between the pressures that exist respectively in the capacity 28 and in the channel 20 is greater than the rating of the spring 33.

FIG. 3 is the functional diagram of the elements shown in FIG. 2, and it uses the same references. Thus, when the pump is in operation, the pressure in the channel 20 varies between the pump delivery pressure and the pump suction pressure.

During the initial strokes of the piston 8, when the pump is put into operation, after the circuit of the working chamber 7 has been filled, a fraction of the working fluid that is to be found in the capacity 28 becomes trapped in said capacity, and the pressure that exists therein becomes established at the value of the delivery pressure. Thus, during suction strokes of the piston 8, during which de-gassing occurs as a result of the pressure drop to which it is subjected during suction, in particular of any gas dissolved in the oil, the capacity 28 is isolated from the working chamber 7 by the valve member 26. When the pump is put into operation, this gas together with the gas contained in the working fluid circuit accumulates in the top of the channel 20. Given the inertia in the movement of the valve member 26, the pressure that exists in the capacity 28 is in fact always a little less than the delivery pressure, and on each stroke of the pump the valve member 26 rises to allow at least some of the gas that has accumulated under its bottom face to pass into the clearance 25. This gas forms a pocket 34 (FIG. 3) that is situated above the bath of oil in the capacity.

When there is a lack of oil in the hydraulic chamber 7, the pressure that exists in said chamber is such that the force holding the valve member 32 against its seat 31 (typically equal to a value suitable for withstanding the value of the delivery pressure plus the value of the suction) is exceeded and the valve opens, thereby enabling the working chamber 7 to be topped up with additional fluid contained in the capacity 28 under the pocket of gas 34. This ensures continuous compensation for leaks that, even though small as a result of the way the pump is constructed, necessarily exist as in any moving mechanical system. The initial filling of the working fluid circuit enables this excess fluid needed for compensation to be built up. The consumption of working oil as a result of leaks can be seen through the transparent plug 29. The level of the bath in the capacity 28 can be monitored therethrough (e.g. the end of the rod of the valve member 32 can be seen to emerge in the surface of said bath).

FIG. 4 shows a variant of the embodiment described with reference to FIGS. 2 and 3. This variant embodiment enables the rating of the de-gassing and topping up valve to be preadjusted independently of the operating conditions of the pump, and in particular it enables the maximum delivery pressure to be preadjusted to a value that is directly associated with the desired degree of suction.

A tubular endpiece 40 is fitted in leaktight manner by being screwed into the pump body 6, at the outlet of the channel 20. This endpiece defines an internal chamber 40*a* that communicates with the channel 20 via a seat 41 formed at its base and facing towards the channel 20. A valve member 42 is urged against the seat by a spring 43. The valve member 42 is guided in sealing sliding in a tubular jacket 44 that is fitted in sealed manner by screw-fastening onto the top of the endpiece 40. The valve member 42 has an internal channel 45 that also communicates with the channel 20 via a seat 46 against which a valve ball 47 is urged under the effect of its own weight or with the help of a very weak return spring. The ball co-operates with the channel 45 to define a de-gassing passage 48. The channel 45 opens out into the chamber 40*a* of the endpiece. In its upper portion, the valve member 42 possesses a sealed capacity 49 that communicates with the chamber 40*a*. This sealed capacity is closed by a transparent top plug 50. It should be observed that the spring 43 is mounted in an inside space 44*a* of the jacket 44 for guiding the valve member 42, said space being closed by a plug 51 that is likewise transparent, for protecting this space that remains at atmospheric pressure.

During the initial strokes of the piston 8, after the circuit of the working chamber 7 has been boosted, when the pump is put into operation, a fraction of the working fluid that is to be found in the chamber 40*a* and in the capacity 49 becomes trapped therein, and the pressure which exists in that fluid becomes established at the value of the delivery pressure. Thus, during the suction strokes of the piston 8, during which de-gassing takes place in particular of any gas that is dissolved in the oil as a result of the pressure drop to which it is subjected during suction, the chamber 40*a* and the capacity 49 are isolated from the working chamber 7 by the valve member 42. While the pump is being set into operation, this gas plus any gas that is contained in the working fluid circuit accumulates in the top of the channel 20. Given the inertia in the movement of the valve member 26, the pressure that actually exists in the chamber 40*a* and in the capacity 49 is always a little less than the delivery pressure, and on each stroke of the pump the valve member 42 rises and allows at least some of the gas that has accumulated under the bottom face of said valve member to pass into the passage 48. This gas forms a pocket 42 that is situated above the bath of oil in the capacity 49.

If there is a shortage of oil in the hydraulic chamber 7, the pressure that exists in this chamber is such that the force from the spring 43 keeping the valve member 42 on its seat 41 (which force is typically equal to a value that is suitable for withstanding the pressure reduction due to suction plus the sliding resistance due to the sealing ring between the jacket 44 and the valve member 42) is exceed and the valve opens, thereby enabling the working chamber 7 to be refilled with additional fluid that was contained in the chamber 40*a* and the capacity 49, under the pocket of gas 52. As in the above-described configuration, leak compensation is thus ensured on a continuous basis. The initial filling of the working fluid circuit serves to set up this excess fluid that is needed for compensation purposes. The consumption of working oil by leaks can be seen through the transparent plugs 50 and 51. The level of the bath in the capacity 49 can be monitored therethrough.

Naturally, the invention is not limited to the embodiment described but covers any variant coming within the ambit of the invention as defined by the claims.

In particular, although the presence of capacities 28 and 49 is extremely advantageous in combination with the diaphragm secured to the piston head, they could be omitted and replaced by some other system for compensating oil leaks.

What is claimed is:

1. A hydraulically-controlled diaphragm pump comprising:

a pump head in which a first deformable diaphragm defines a pump chamber;

a pump body that co-operates with the first diaphragm to define a hydraulic working chamber; and a piston with a piston head, the piston being mounted to move back and forth in the pump body so as to form a controlled movable wall of the working chamber;

wherein the movable wall also includes at least one second diaphragm secured to the piston head and to the body of the pump, the second diaphragm providing sealing for the working chamber, wherein the working chamber is connected to a sealed reserve capacity for topping up and de-gassing the working chamber via two mutually parallel channels, the first channel for de-gassing being fitted with a check valve in series with a constriction, the forward direction through the check valve being towards the reserve capacity, the second channel for topping up being fitted with a rated check valve with the forward direction through the rated check valve being towards the working chamber, wherein the topping-up channel is provided in the body of the de-gassing check valve.

2. The diaphragm pump according to claim 1, wherein a third diaphragm is arranged between the piston and the pump body to co-operate with the second diaphragm secured to the piston head to form a closed chamber within the pump body, the closed chamber being filled with oil to provide hydraulic coupling between the second diaphragm and the third diaphragm.

3. The diaphragm pump according to claim 2, wherein the second diaphragm includes a concave portion and the third diaphragm includes a concave portion, the two concave portions having their concave sides facing in opposite directions, the concave sides of the concave portions facing outwards from the closed chamber.

4. The diaphragm pump according to claim 1, wherein the piston comprises two telescopic portions that are held in an extended position by a spring rated to a value that corresponds to a safety setting.

5. The diaphragm pump according to claim 1, wherein the rated value of the rated check valve is such that the pressure threshold in the working chamber that causes it to open is no greater than the suction capacity of the diaphragm pump.

6. The diaphragm pump according to claim 1, wherein the reserve capacity is situated above the working chamber when the pump is in operation, and wherein the de-gassing check valve includes a heavy body.

7. The diaphragm pump according to claim 1, wherein the reserve capacity is made in the form of an assembly fitted with de-gassing and topping-up valves and fitted to the pump body, said assembly including at least one transparent lug for monitoring the level of oil in the reserve capacity.

* * * * *